United States Patent [19]

Ibrahim

[11] 4,389,856

[45] Jun. 28, 1983

[54] REFRIGERANT GAS HEATER SYSTEM FOR DISPLAY CABINETS

[75] Inventor: Fayez F. Ibrahim, Niles, Mich.

[73] Assignee: Tyler Refrigeration Corporation, Niles, Mich.

[21] Appl. No.: 296,625

[22] Filed: Aug. 27, 1981

Related U.S. Application Data

[63] Continuation-in-part of Ser. No. 162,203, Jun. 23, 1980, abandoned.

[51] Int. Cl.[3] ..... A47F 3/04; F25B 47/00

[52] U.S. Cl. ..... 62/248; 62/117; 62/278

[58] Field of Search ..... 62/277, 278, 248, 196 B, 62/117

[56] References Cited

U.S. PATENT DOCUMENTS

| | | | |
|---|---|---|---|
| 2,420,240 | 5/1947 | Haggerty | 62/277 X |
| 3,010,288 | 11/1961 | Jacobs | 62/277 X |
| 3,125,864 | 3/1964 | Ural | 62/248 X |
| 3,157,306 | 11/1964 | Courson | 62/277 X |
| 3,167,931 | 2/1965 | Bryson | 62/277 |
| 3,451,226 | 6/1969 | Shriver | 62/277 X |
| 4,024,728 | 5/1977 | Gustafsson | 62/238.6 X |
| 4,141,222 | 2/1979 | Ritchie | 62/238.6 X |
| 4,197,718 | 4/1980 | Abraham et al. | 62/277 X |
| 4,246,760 | 1/1981 | Cann et al. | 62/197 X |

*Primary Examiner*—William E. Tapolcai

*Attorney, Agent, or Firm*—LeBlanc, Nolan, Shur & Nies

[57] ABSTRACT

A low temperature refrigerant gas heater system for warming structural parts of refrigerated display cabinets sufficiently to prevent the formation of moisture condensate. A desuperheating means is provided for an auxiliary gas flow line taken off from a primary refrigeration circuit in order to lower the temperature of a portion of the refrigerant gas flow to within the range of about 80° F. to 130° F. for this purpose. The auxiliary gas have pressure-temperature-enthalpy conditions located in the superheated region or the saturation envelope area of a pressure-enthalpy diagram within these temperature limits. The use of low temperature refrigerant gas in the auxiliary flow line avoids heater line warping and buckling and customer inconvenience and discomfort problems which are incurred by use of high temperature compressor refrigerant gas.

50 Claims, 11 Drawing Figures

REFRIGERANT GAS HEATER SYSTEM FOR DISPLAY CABINETS

RELATED APPLICATIONS

The present application is a continuation-in-part of the inventor's copending application entitled REFRIGERANT GAS HEATER SYSTEM FOR DISPLAY CABINETS, Ser. No. 162,203 filed June 23, 1980, now abandoned. The disclosure of this application is hereby incorporated by reference as though fully set forth herein.

BACKGROUND OF THE INVENTION

The present invention relates to a refrigerant gas heater system for warming portions of the cabinet structure of refrigerated display cases used in retail food and supermarket outlets. More particularly, it relates to a refrigerant gas heater system which utilizes heat energy added to the refrigerant gas by the compressor which is normally rejected and thus lost into the ambient environment. Thus, this invention utilizes energy produced during the normal refrigeration cycle to heat structural portions of the display cabinet in order to maintain those portions at temperatures above the dew point for ambient moisture conditions in order to prevent moisture condensation which could interfere with the operation and merchandise functioning of the cabinets.

The term "refrigerated," in accordance with the present invention, is intended to incorporate those display cabinets or cases maintained at a temperature of at least 32° F., such as display cases utilized for display of milk or fresh foods, and those cases maintained below 32° F., such as frozen foods cases. In addition, references are made herein to the use of transparent doors with such cabinets, since those are the types of doors most frequently used in such retail outlets. Other types of doors could also be employed within the scope of the present invention.

During the operation of the refrigerated display cabinet in retail food and supermarket outlets, structural portions of those cabinets act as condensation surfaces for ambient moisture, since the temperature of those surfaces is sometimes below the dew point at the prevailing ambient humidity conditions. Some of this condensation accumulates on the door jambs and mullions which are disposed about the door panels. This presents the possible dripping of water on the floor in front of the cabinet with resulting hazards for slipping. Another problem is that condensation on various surfaces can drip into the cabinets to cause operating and sanitation problems of the latter due to the promotion of bacterial growth. Cold moisture condensation is also objectionable to customers, particularly when their hands or clothing come in contact therewith as they select products from the display cabinets.

It is, therefore, considered desirable to provide heating for those structural portions of the cabinets which are subject to these condensation problems. One approach is to utilize electrical resistance heaters placed in contact with various cabinet structural parts. Another approach is to force an air stream over the surface for which condensate removal is desired. Both ambient air and heated air flow streams can be employed for this purpose, but the use of air flow streams is not practical to implement for all cabinet parts. Due to the increased cost of energy, efforts have been made to avoid the use of condensate removal systems which utilize additional energy inputs for the condensation removal, such as resistance heaters and supplemental fan systems.

Another approach for heating the structural portions of refrigerated cabinets most likely to encounter moisture condensate formation is the use of a hot liquid refrigerant line, particularly, a line taken from the refrigeration circuit immediately downstream of the condenser. Such liquid lines contain a low level of sensible heat which can be insufficient for preventing moisture condensate formation in situations where high ambient humidity and low operating of the refrigerated display cabinets are encountered. This problem is of increasing importance, since the art of refrigeration in display cabinets is moving toward the use of lower liquid refrigerant temperatures and lower compressor head pressures.

Another approach in the prior art is to use a hot refrigerant gas line as a heater. A problem encountered with this alternative is that the compressor gas is at an elevated and superheated temperature which may cause long gas lines containing such gas to buckle and even rupture. A typical compressor discharge terperature range is from 150° F. to 240° F., This temperature range will cause extensive buckling problems which then necessitates the use of relatively expensive heat-expansion loops and hanger systems and, particularly, when the heater tubing is placed in close contiguous heat exchange contact with various structural portions of the display cabinets, th expansion and contraction problems can be severe. Particularly, due to the fact that the heater system may not be employed continuously, metal in the heater lines will be alternatively heated by the hot refrigerant gas contained therein and cooled during time periods when flow of hot gas is interrupted. This effect is accentuated by the heater lines being cooled during the start-up of a refrigeration cycle by contact with cold air within the cabinet immediately following a defrost cycle. Effective heat transfer contact between the heater lines and the other structural parts is also difficult to maintain under these circumstances.

Another problem encountered with the use of hot gas heater lines is that temperatures in the above range can cause unpleasant experiences for customers including injury when fingers, hands, and forearms come in contact with the heated structural portions of the display cabinets. This is a problem particularly with respect to children who often touch these structural parts of display cases in food stores.

These general background statements are derived from several groups of prior art patents. Various air flow means to prevent condensation formation on refrigerator structures are shown in the following U.S. Pat. Nos. 2,673,455 to Brinkoeter; 2,672,735 to Fusselman; 2,706,387 to Swanson, 3,180,109 to Kimmel; and 4,009,586 to Skvarenia.

U.S. Pat. No. 3,371,503 to Perez, and assigned to the same assignee as the present application, discloses the use of a hot liquid line for heating several structural parts in refrigerated display cabinets. Other patents of this type are U.S. Pat. Nos. 2,657,546; 4,192,149 and 4,197,718. Liquid heater lines are also disclosed in co-pending U.S. patent application Ser. No. 36,661 filed May 7, 1979 by Fayez Ibrahim and Arthur Perez and assigned to the same assignee as the present application. Refrigerant liquid heater system such as shown in U.S. Pat. No. 3,839,879 for periodically removing frost and ice from the evaporator coils are distinquishable from the present invention due to the differences in problems perceived, concept, construction, mode of operation and result.

The use of refrigerant gas as a heat exchange medium, which encounters one or more of the above-referred to problems, is disclosed in U.S. Pat. Nos. 2,287,997 to Jarvis; 3,308,635 to Tenniswood; 3,835,660 to Franck; and 4,158,294 to Keeling. U.S. Pat. No. 2,960,884 to Quick discloses both an electric resistance heater and a hot gas heater for deicing a duct.

The prior art as represented by these patents does not appear to have recognized the problems inherent in the use of high temperature gas lines from the compressor with respect to the heating of refrigerated cabinet structural parts such as door mullions and jambs. The solutions found for these problems do not include the disclosed and claimed use of an adequate flow of low temperature refrigerent gas which has sufficient sensible heat and/or heat of condensation to provide the heating function and yet avoid the problems set forth stemming from overly high compressor gas discharge temperatures.

An advantage of the present invention is the energy conservation incurred by the use of refrigerant compressor gas to heat the structural parts of the display cabinet rather than using additional electrical input in order to heat these parts by resistance heaters. An average supermarket may employ about 96 feet of glass door case length for low temperature use and up to about 72 feet for medium temperature uses. The anticondensate input for a low temperature case is approximately 700 watts per 12 foot case during the refrigeration cycle. A medium temperature case utilizes about 400 watts per 12 foot case. Replacement of electrical resistance heaters for door mullions in such cases, for this average example, can result in a savings of 70,000 killowatts per year which translates to $3500 per year at a 5 cent per killowatt hour electric charge.

SUMMARY OF THE INVENTION

A low temperature refrigerant gas heater system is provided for warming structural parts of refrigerated display cabinets sufficiently to prevent the formation of moisture condensate thereon. The temperature of the refrigerant gas utilized for this purpose is between the range of about 80° F. to 130° F. at the inlet end of the heater flow line. In order to provide this low temperature refrigerant gas, a desuperheating means is used after the heater gas is taken off from the primary refrigeration circuit in an auxiliary gas flow line which forms part of the gas heater system. The refrigerant gas employed in the heater system is returned to the refrigerant circuit as a gas or a gas/liquid mixture.

The refrigerant gas taken into the heater system flow line from the primary refrigeration circuit after passing through the desuperheating means is maintained at a low superheat temperature. This gas is then passed through the auxiliary gas flow line to warm structural parts of the associated display cabinet. The gas can be maintained in a superheated condition during its use for warming the refrigerated metal parts or it can be allowed to condense in the auxiliary heater flow line in which event the latent heat of condensation is added to the heat exchange. The refrigerant gas used in the auxiliary line is maintained within prescribed temperature and superheat conditions which can be best delimited by reference to a refrigerant pressure-enthalpy diagram having a standard saturated liquid-vapor envelope. The prescribed conditions are that: (1) the gas temperature is within the limits of 80° F. to 130° F. in both the saturated liquid-vapor envelope and the superheated region and (2) at a pressure at least equivalent to the equilibrium saturated vapor pressure existing at 50° F., and (3) having an enthalpy at least equal to that of saturated liquid at 130° F. The operating area of a pressure-enthalpy diagram defined by these conditions extends across the saturation envelope and into the superheated region between the limits of 80° F. and 130° F. and has end boundaries defined by the above pressure and equilibrium saturation conditions. This prescribed set of heater gas conditions is generic to all refrigerant gases and about 15% to 20% of the operating area lies in the superheated region. Thus the operating area can be defined as covering refrigerant gas conditions between the limits of 80° F. to 130° F. in both the saturation envelope and the superheated region between these temperature limits wherein about 15% to 20% of the area is in the superheated region and having an enthalpy condition at least that of the saturated liquid phase at 130° F.

These conditions for the refrigerant gas employed in the heater system gas flow line are achieved by employing a desuperheating means for lowering the temperature of the compressor discharge gas to within the above limits. Various desuperheating means can be employed.

It is, therefore, an object of the present invention to provide an auxiliary refrigerant gas flow line located in contact with a cool portion of a display cabinet structure in which the refrigerant gas is maintained at a temperature within the range of about 80° F. to 130° F. within said flow line and can be at a low superheated vapor enthalpy state.

Another object of the present invention is to provide a refrigerant gas heater system containing an auxiliary flow line located in contact with a cooled structural portion of a refrigerated display cabinet in which a desuperheating means is provided for bringing the refrigerant gas into the above state for use in the heater flow line.

Specific preferred embodiments of the invention will be described below with reference to the appended drawing figures.

DESCRIPTION OF THE PREFERRED EMBODIMENTS

Figure 1:
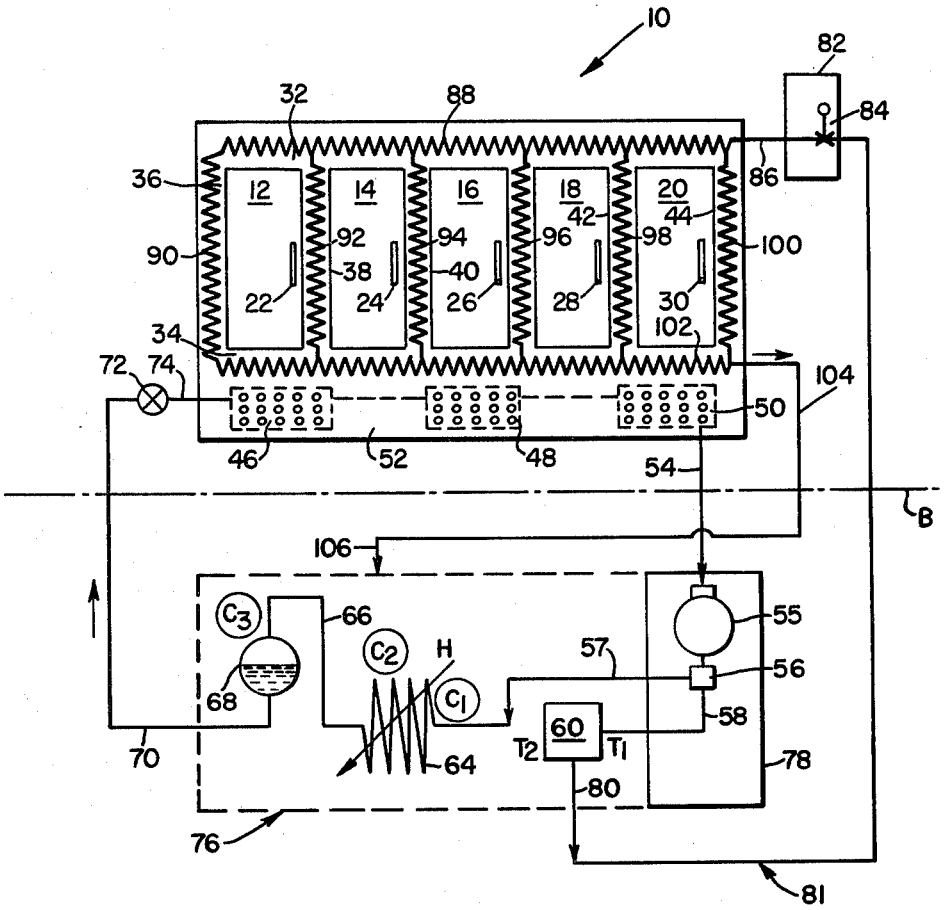
FIG. 1 is a schematic view of a refrigerated display cabinet in which door mullions and door jambs are heated by an auxiliary gas flow line using gas drawn from the primary refrigeration circuit.

Referring to FIG. 1, a refrigerated display cabinet 10 is shown having a plurality of glass doors 12–20 and associated handles 22–30. The display cabinet has an upper door jamb 32 and a lower door jamb portion 34 both extending horizontally above and below doors 12–20, respectively. The doors are positioned vertically between door mullions 36–44. The refrigeration function for display cabinet 10 is provided by evaporator coil boxes 46–50 located in bottom portion 52 of the cabinet. Air circulation fans (not shown) are also enclosed within cabinet 10.

The evaporator coil boxes are shown connected serially as part of a primary refrigeration circuit and expanded refrigerant gas from coil boxes 46–50 is drawn into suction line 54 of compressor 55. The discharge high pressure side of compressor 55 is connected to a proportion valve 56 which divides the hot gas discharge to a portion which continues in the main refrigeration circuit via line 57 and into an auxiliary gas line 58 which flows through a desuperheating means 60 which provides for lowering the compressor refrigerant gas temperature from the discharge temperature $T_1$ to a desuperheated temperature $T_2$. The $T_1$ temperature range is from about 150° F. to 220° F. The desuperheater means 60 reduces the refrigerant gas temperature to between about 80° F. to 130° F. The auxiliary by-pass line 58 takes in about 15% to 25% of the gas flow from the compressor discharge. The valve 56 can be of either fixed or variable proportion types.

The main circuit refrigerant gas then flows through line 57 into condenser 64 where heat is extracted therefrom as shown by the heat removal arrow "H". Sufficient heat is removed to change the refrigerant from the gaseous phase to the liquid phase which predominates in line 66. This line leads to a gas/liquid interface receiver 68 and hence line 66 is connected to the gas side of the receiver. The liquid side of the receiver 68 is connected via line 70 to an expansion valve 72 which is joined to a low pressure gas line 74. This low pressure line is connected to the series of evaporator coils 46–50 to complete the primary refrigeration circuit.

The refrigerant flow within the above described primary circuit is forced by compressor 55 in a clockwise direction wherein earlier positions in the circuit are denoted as upstream locations and later positions are denoted as downstream locations. Hence, returning evaporator gas line 54 is upstream from compressor 55 whereas hot gas discharge line 58 is downstream from the compressor. If desired, evaporator gas line 54 can be placed in heat exchange relationship to the refrigerant liquid line 70 in order to reduce the temperature of the liquid in line 70 to a super-cooled state to provide for increasing the efficiency of refrigeration. When this is done, the evaporator gas line 54 inlet to such a heat exchanger operates at about −20° F. and this line can be warmed to about approximately 40° F. at the outlet by utilizing the liquid line 70 at a 70° F. to 90° F. inlet and 50°–70° F. outlet temperatures prior to passage of the liquid refrigerant through expansion valve 72.

The components described above for this primary refrigeration circuit are separated in that the evaporator coil boxes 46–50 and expansion valve 72 are located within or adjoining refrigerated display cabinet 10 whereas the other refrigeration components 55–68 can be located in a heater system 76 which includes the compressor, desuperheating means, and condenser. System 76 can be in a remote location with respect to cabinet 10. Within heater system 76, a standard compressor 55 is operated within an enclosure 78, illustrated by solid lines. The desuperheating means 60, the condenser 64 and the gas/liquid receiver 68 are located within the dashed lined portion of system 76. A second auxiliary refrigerant gas flow line inlet 80 is connected to the desuperheating means 60 within the dashed lined portion of heater system 76. Gas flow line 81 extends from the remote position of heater system 76 across the boundary line B and into a flow line control means 82 wherein a regulated valve 84 controls the flow of refrigerant gas. Control means 82 is in turn connected to gas line 86 which is integrally connected to upper door jamb heater line 88 of the auxiliary gas flow line 81. As shown, this portion 88 of flow line 81 serves as a manifold for providing refrigerant gas to a plurality of gas flow lines 90–100 which are positioned in contiguous contact with the inner walls of door mullions 36–44, respectively. These door mullions lines feed into a common return gas flow line 102 which is, in turn, connected to a return line 104 which extends across boundary B and into a connection point within the dashed line portion of heater system 76, as shown generally by outlet end 106. The low temperature refrigerant gas is taken into the inlet end 80 of gas flow line 81 and delivered through control means 82 to the door jamb and mullion gas flow heater lines and is returned in line 104 to outlet end 106.

The returning gas flow line outlet end 106 can be connected to any of the positions denoted by $C_1$, $C_2$, and $C_3$ which are illustrated at the immediate upstream side of condenser 64, at an intermediate position along the condenser coils, and at the immediate downstream side of condenser 64, respectively. The return outlet connection to the receiver point, $C_3$, is a preferred embodiment of the present invention. Inlet end 80 is thus a refrigerant gas sourcing point located downstream from the compressor and upstream from the expansion valve 72.

In the first embodiment described above, refrigerant gas is taken from the primary refrigerant circuit in the valve 56 circulated through the auxiliary gas flow lines 58 and 81 and the associated door jambs and mullion heater lines and returned via line 104 to one of the connection points denoted by C for condensing. The gas taken off after the desuperheating means 60 has a temperature within the limits of about 80° F. to 130° F. and is in a low superheated state. The sensible heat derived from the gas flow is sufficient to warm to structural portions of cabinet 10 in order to prevent the formation of condensate on the door jambs and mullions which, in extreme circumstances, can form frost areas which, in turn, can cause doors 12–20 to stick.

Flow line control means 82 can be operated in response to combinations of the ambient temperature and humidity conditions and the temperatures of the structural portions of cabinet 10.

The employment of desuperheating means 60 enables gas having a temperature of from 80° F. to 130° F. to be used in the auxiliary gas flow lines and in the door jambs and mullion heat lines. This largely alleviates the problems of expansion and contraction depending upon temperature differentials and effectively overcomes the problems set out above with respect to the use of high temperature compressor discharge gas. In this manner gas flow line buckling and rupturing is prevented and customer inconvenience is avoided.

Auxiliary gas flow lines of the above described type can be utilized with respect to glass door type multi-shelf freezers, dairy and deli cabinets as shown. The same type of auxiliary gas flow lines are useable in open front and well-type freezer cabinets also.

Figure 2:
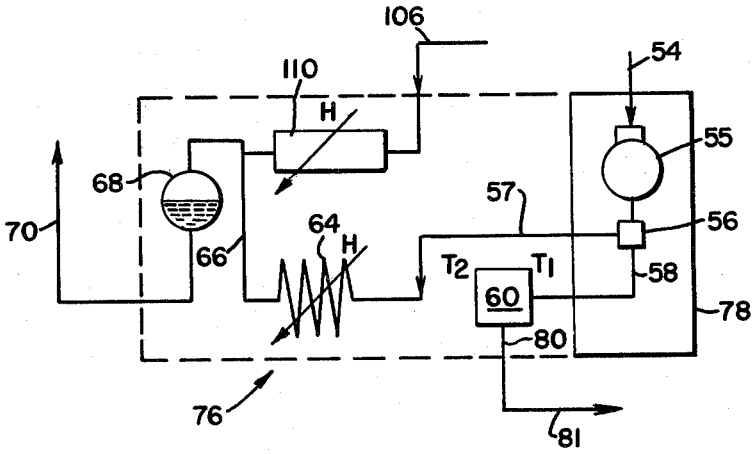
FIG. 2 is a schematic view of the inlet end and outlet connections for the auxiliary refrigerant gas flow line in a preferred embodiment of the heater system shown in FIG. 1.

Referring to the preferred embodiment shown in FIG. 2, the return gas flow line outlet 106 can be connected to a secondary condenser 110 in order to condense the returning gas to the light phase prior to entry into liquid line 66 and thereafter line 70 which conducts the refrigerant liquid to expansion valve 72 (shown in FIG. 1). The other elements in FIG. 2 are described above. Condenser 110 can be a liquid, air or refrigeration coil heat exchanger.

Figure 3:
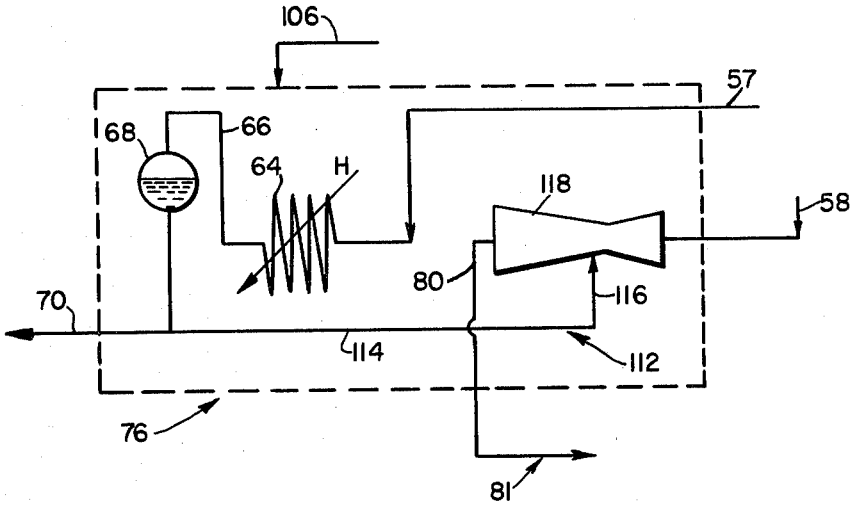
FIG. 3 is a schematic view of a first embodiment of a desuperheater means.
Figure 4:
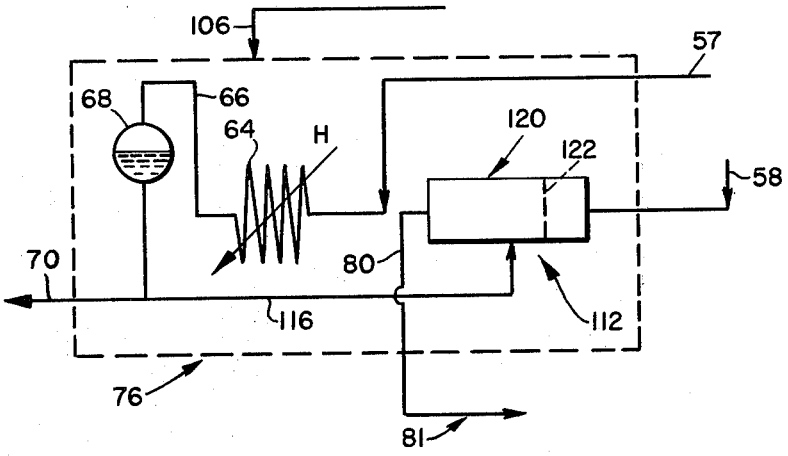
FIG. 4 is a schematic view of a second embodiment of the desuperheating means.

FIG. 3 shows a schematic diagram for one embodiment of a desuperheating means 112 located within remote positioned heater system 76. A liquid refrigerant line 114 is connected from the liquid side of receiver 68 at point 116 to the throat of a venturi tube 118. Flow of the auxiliary line compressor discharge gas through line 58 causes the high pressure discharge gas to undergo a pressure drop sufficient to draw in refrigerant liquid through line 114 to flash-mix the liquid with the gaseous phase in order to lower the temperature of the compressor discharge gas to within the temperature range of about 80° F. to 130° F. This desuperheated gas is then taken off at auxiliary flow line inlet 80 and used for heating the cabinet structural portions as described above with respect to FIG. 1 and thereafter returned to the heater system 76 via line 106 as described above. FIG. 4 shows another modification of a desuperheating means 112 which is analogous to that described in FIG. 3 above. In this modification, a mixing tube 120 having an orifice plate 122 is provided within the main refrigerant circuit and liquid from the receiver 68 flows in line 116 to mixing tube 120 via the pressure differential created upon passage of the high pressure discharge compressor gas through the orifice 122. The saturated liquid refrigerant is flash-mixed with the hot discharge gas and extracted by inlet and end 80 of auxiliary gas flow line 81. The return gas line 106 from cabinet 10 is also shown.

Figure 5:
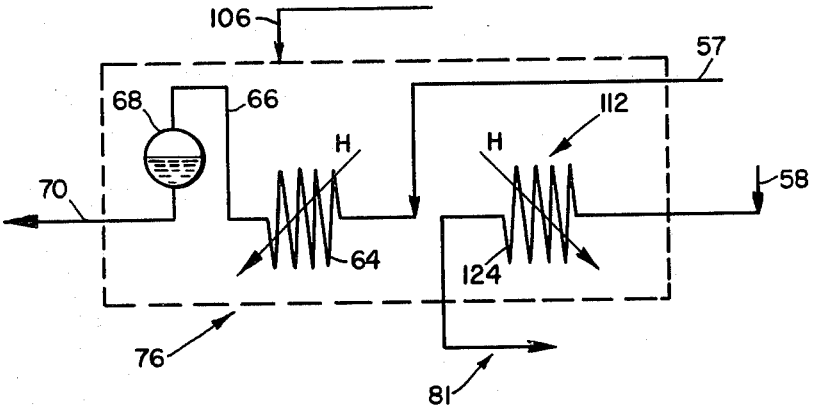
FIG. 5 is a schematic view of a preferred embodiment of the desuperheating means.

FIG. 5 shows a preferred modification of a desuperheating means 112 which consists of a desuperheater 124 which is operated by cooling a set of gas flow coils by a lower temperature fluid. This heat extraction to the low temperature fluid is depicted by arrow H, consistent with the other condensers, and can be supplied by an ambient air or a water heat exchanger operating with fluid external to the refrigeration circuit. One preferred mode for functioning of this modification is to utilize a relatively straight length of tubing as the desuperheater and to arrange this line in an under-the-floor trench which is often used in supermarket doors. Such a trench functions as a heat sink at about 50° F. to 55° F. and provides for adequate desuperheating. Another mode of operation for a desuperheater is to utilize a gas flow coil and to cool this coil by natural convection flow of ambient air which is usually at 65° F. to 80° F. In this mode the ambient air functions as a heat sink. The heat exchange can also be provided for by contact with an additional coil positioned within line 54 of FIG. 1 which operates at a below 0° F. temperature. Thereafter line 54 can flow into the suction side of compressor 55. The latter of these two desuperheating fluids provides the additional advantage of raising the thermal efficiency of the described refrigeration circuit and auxiliary gas flow line.

Figure 6:
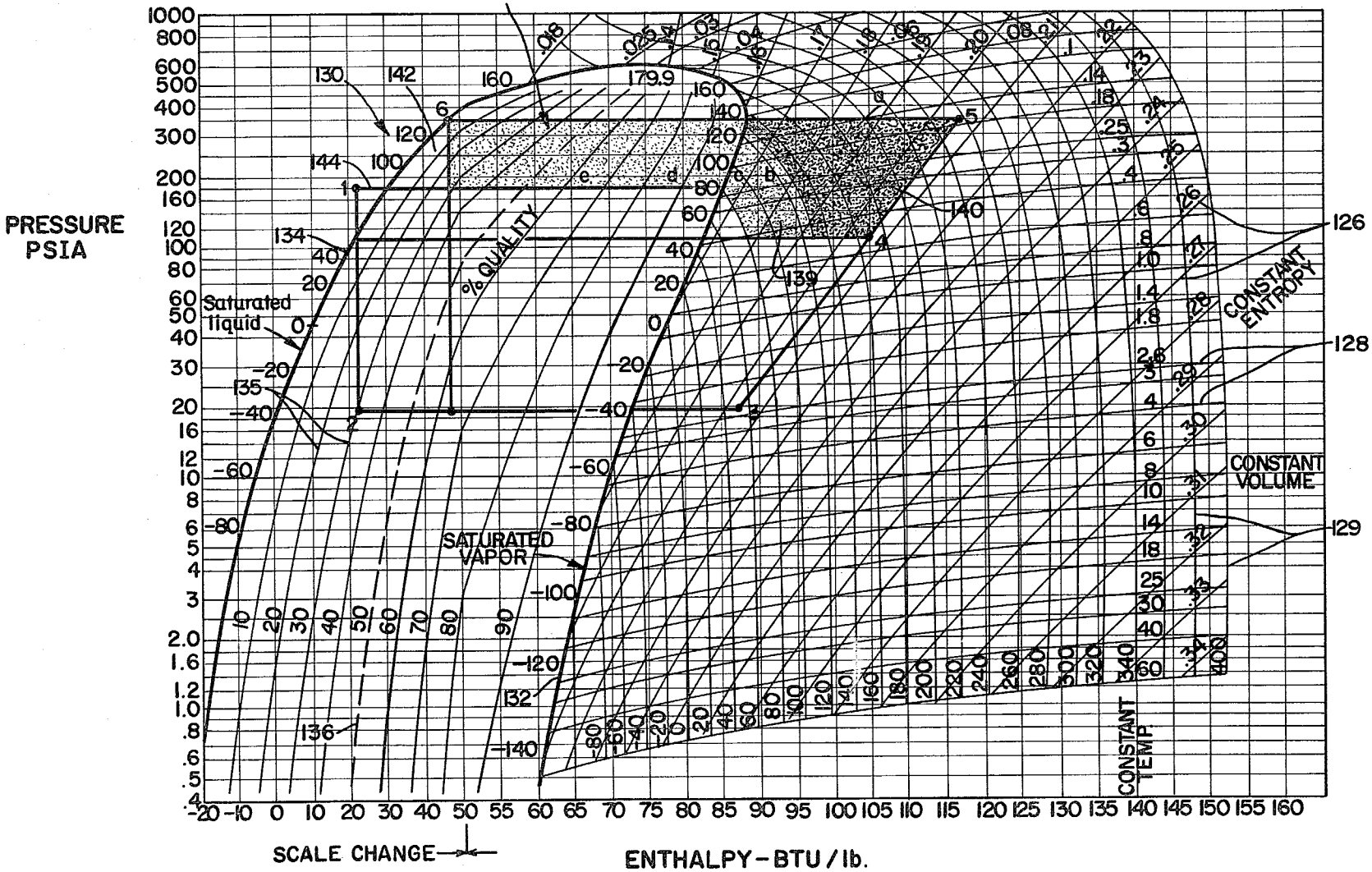
FIG. 6 is a typical pressure-enthalpy diagram for a refrigerant fluid showing the operating area of the desuperheating refrigerant gas according to the present invention by stippling and the unusable superheated region by a different stippling.

FIG. 6 shows a representative pressure-enthalpy diagram for a typical refrigerant gas wherein parallel constant entropy lines 126, constant volume lines 128 and constant temperature lines 129 are shown. The saturated vapor/liquid envelope 130 is shown by the bold line parabolic-shaped curve with the saturated vapor line 132 shown as the right hand vertical portion and the saturated liquid line 134 shown by the upperwardly curving left hand portion. The proportions of liquid and vapor are shown by the internal curves 135 within this envelope with the dashed curve 136 representing 50/50 weight proportion and each of the internal solid curves representing a 10% change in the proportions moving in either horizontal direction across the envelope. The horizontal temperature parameters across the saturation envelope 130 are also set forth. The operating area 138 for the refrigerant gas conditions used in the heater flow lines is shown by shading. This area is bound at the lower line across the saturation envelope and then into the superheated gas region to the right of the saturated vapor line 132 and at the top horizontal position by the parallel 130° F. line. The extreme left hand vertical portion of area 138 is bound by the constant enthalpy parameter which intersects the saturated liquid line at 130° F. The extreme right hand side of area 138 extends past the saturated vapor line 132 in order to encompass a low superheated vapor region 139 within the limits of 80° F. to 130° F. which extends downward to the equilibrium saturated vapor pressure existing at 50° F. This superheated area of the operating area 138 can represent about 15% to 20% of the total area encompassed by areas 138 and 139.

In operation, refrigerant gas discharging from compressor 55 through proportion valve 56 will be at conditions represented along the right-hand line of the shaded high superheated area 140 on the diagram. It is necessary to desuperheat the gas in order to place the gas condition within the low superheated area 139 within the useable operating area 138 prior to its entry into the inlet 80 of auxiliary flow line 81. The gas entering the inlet end 80 of the flow line has a temperature between 80° F. to 130° F. and a pressure of at least the saturated vapor at 50° F. as shown by the lower horizontal side of area 138. The gas in flow line 81 then gives up its sensible heat as it passes through the upper manifold 88 and door mullion lines 90–100 and the lower manifold line 102. For some operating conditions, control means 82 may permit only a small flow of gas through line 81 due to the low heating requirements of the structural parts of the display cabinet. When this occurs, the gas returning to the remote position system 76 in line 104 of FIG. 1 can be at superheated conditions located within area 138 and to the right side of the saturated vapor line. With greater heating requirements and by adjusting the control apparatus and valve settings, some refrigerant liquid can be formed by condensation of the gas in the auxiliary flow line 81, particularly, in those portions of line 81 located within the cabinet 10. The latent heat of condensation can then be used to heat the structural members of cabinet 10. Thus, a mixture of gas and liquid can be returned in line 104 of FIG. 1 and in such cases entry of the auxiliary flow line via outlet 106 will be at one end of points $C_1$, $C_2$ or $C_3$ depending upon the proportions of liquid returned. These positions will represent liquid/gas proportions successively moving to the left across the operating area 138 within the saturated gas/liquid envelope 130.

An illustrative set of refrigerant gas conditions within the heater system 76 and the auxiliary gas flow line 81 is given in FIG. 6 by reference points a–e. A set of temperature-pressure enthalpy conditions in valve 56 of FIG. 1 is given as point a. Passage through the desuperheater means 60 results in a lower superheated vapor temperature and pressure point b within operational area 138. The desuperheater means 112 shown in FIGS. 3 and 4 both produce pressure drops and this is reflected in the lower position of point b. The flow of refrigerant gas through the auxiliary gas line 81 and the included heater lines can change the state to point c if no refrigerant gas condensation occurs. When a phase change of the refrigerant gas occurs in the auxiliary lines the gas state of the outlet and 106 can be d or e depending upon the resulting proportion of liquid. The sensible heat and heat of condensation available for heat transfer from the auxiliary gas line 81 can be represented by the change in enthalpy from point b to point e or to a point further to the left in operating area 138. This covers an enthalpy change of about 35 to 55 BTU per pound of refrigerant.

The outlet end of the auxiliary flow line is connected to one of the condenser points $C_1$, $C_2$ or $C_3$, the last of which feeds directly into the receiver 68, or into the secondary condenser 110 as shown in FIG. 2. These condensers then remove additional heat to condense the remaining refrigerant vapor so that saturated liquid or slightly subcooled liquid is fed into the receiver 68. The conditions of the returning auxiliary refrigerant gas/liquid mixture as it transitions from outlet 106 to receiver 68 are within condenser area 142. The refrigerant flow from the auxiliary by-pass line 81 is thus recombined with the primary circuit flow through line 57 at the receiver 68 as the furthest downstream point.

The diagram of FIG. 6 also shows the main refrigeration circuit conditions. The refrigerant in the main circuit saturated liquid line 70 is illustrated as being subcooled along the constant pressure line 144 associated with the 80° F. saturated liquid state to point 1. This subcooling can be accomplished by heat exchanging line 70 with the returning evaporator line 54 which enters such an exchange at about +20° F. When this is done the liquid refrigerant line 70 temperature will be 50° F. to 70° F. and it is then passed through the expansion valve 72 along a constant enthalpy line to point 2 during which the pressure will drop as shown. In evaporator coils 46, 48, and 50 the refrigerant takes in heat from display cabinet 10 and undergoes a phase change to the gaseous state as shown by the movement of conditions to point 3. In an ideal compressor the gas is compressed in an isoentropic manner to a condition represented by the isoentropic line 4 to 5. When the compressor is operated at the highest head pressure, the discharge gas sent through the main refrigeration circuit line 57 is then liquified in condenser 64 as shown by movement from point 5 to point 6 along a constant pressure line. Further cooling by the condenser to 80° F. occurs along the saturated vapor curve 134 or slightly into the subcooled liquid region in order to return the main refrigerant to the condition 1 existing in the receiver 68. In the above description the left-hand demarcation between operating area 138 and the condenser area 142 has been stated in a definite fashion. It is, of course, possible for area 138 to extend slightly further toward the left to the vicinity of the saturated liquid line 134, although complete condensation of the refrigerant gas in the heater lines does not appear feasible as yet.

Any of a wide variety of well known gaseous refrigerants can be employed for the refrigerant in the main refrigeration circuit and the auxiliary flow line 81. Examples are "Freon" 12, "Freon" 502, and "Freon" 22.

Figure 7:
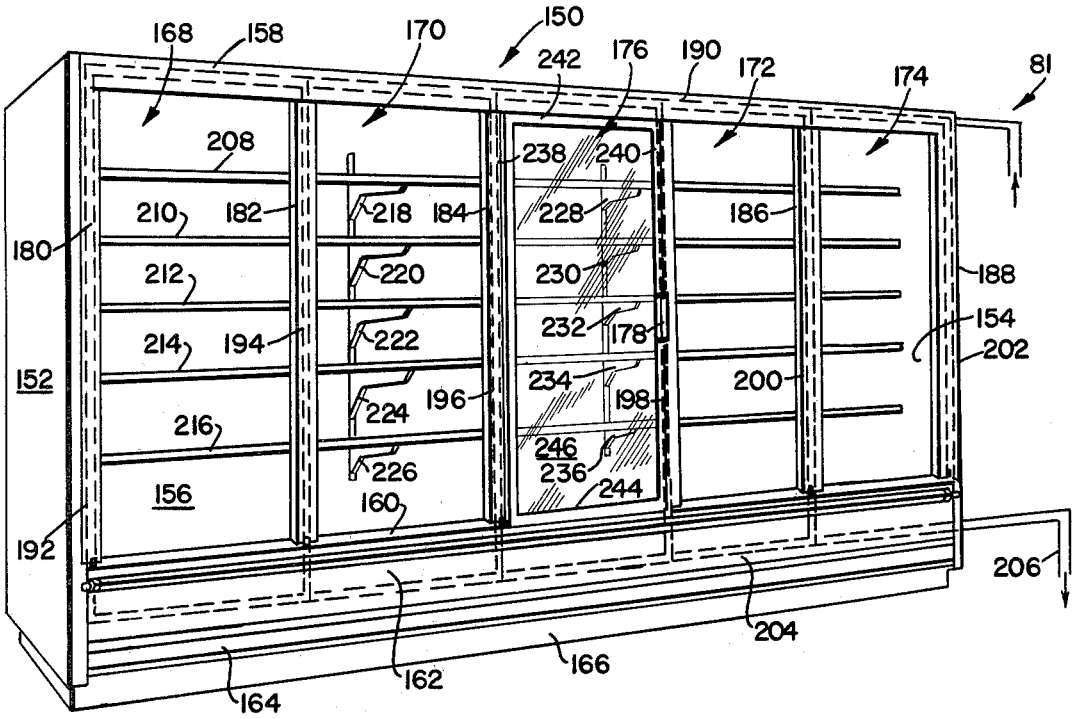
FIG. 7 is a schematic view of a refrigerated display cabinet showing the auxiliary refrigerant gas flow line for heating door mullions and jambs.

Referring collectively to FIGS. 7–11, a series of specific employments of the auxiliary refrigerant gas flow line 81 described above in reference to FIGS. 1–5 are set forth. FIG. 7 shows a glass door refrigerated merchandiser cabinet 150 which has side walls 152 and 154, a back wall 156 and an upper door horizontal door jamb 158, and a lower door jamb 160 which is integral with a bottom front panel 162. Front panel 162 has a bumper rail 164 integrally formed therein above the bottom portion 166 which provides floor support for cabinet 150. As shown in FIG. 7, four of the five doors for access openings 168–174 have been removed, leaving door 176 in place with its associated handle 168. The door mullions 180, 182, 184, 186 and 188 are exposed since in the view shown the overlying doors have been omitted. In other glass door front display cabinets, the door mullions are viewable even with the doors installed as shown schematically in FIG. 1 above. Auxiliary gas flow line 81 is shown connected to the right side of cabinet 150. The upper door jamb is heated by a gas flow manifold line 190. Gas flow lines are shown internally for each of the door mullions as lines 192, 194, 196, 198, 200 and 202. These lines are in contiguous contact with the internal portions of the door mullions whereby sensible heat from the auxiliary gas line can be transferred to the structure of the mullions. The bottoms of the vertical mullion lines 192–202 are connected to a bottom manifold line 204 which then exits from cabinet 150 as return line 206 which is connected to the system 76 shown in FIG. 1.

Also shown in FIG. 7 are the internal product shelves 208–216 which are supported by brackets 218–236. Representative door 176 is supported within cabinet 150 by hinge pins located in the upper and lower door jambs 158 and 160, respectively. The door is formed from a pair of vertical frame members 238 and 240 which are connected to an upper door frame member 242 and a lower door frame member 244. A glass pane 246 is provided for product viewing.

Figure 8:
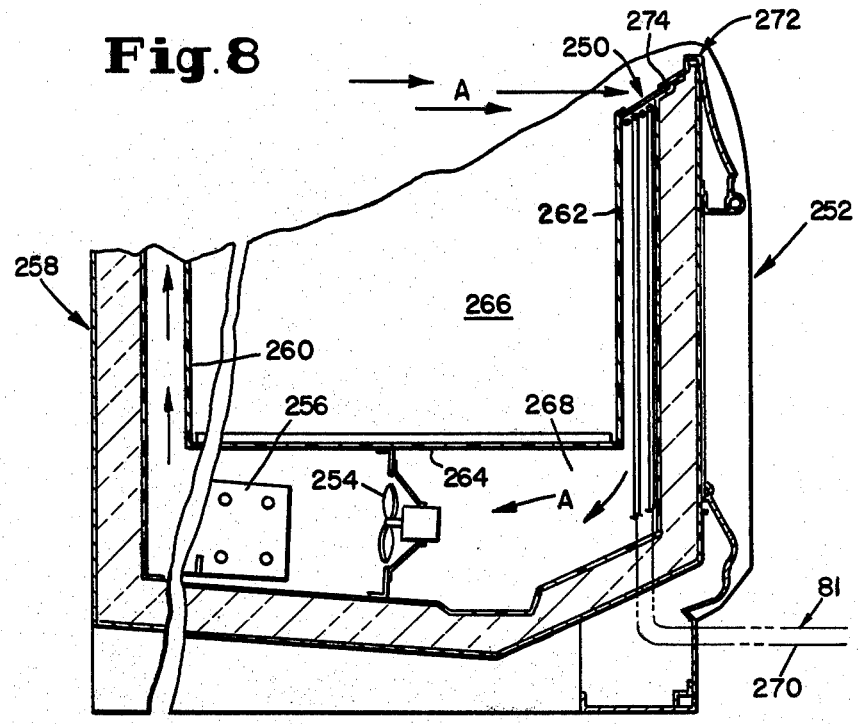
FIG. 8 is a cross-sectional view of a open top refrigerated display cabinet showing the positioning of the auxiliary refrigerant gas flow lines in the grille of a air band conduit and in the rub-rail structure.

FIG. 8 shows another illustration of the use of the auxiliary refrigerant gas flow line 81 in an open top refrigerated display cabinet. The refrigerant gas flow line is used to heat the air grille structure 250 of an open top refrigerated display cabinet 252 which contains a number of conventional components such as a motor driven circulation fan 254, and an evaporator coil box 256 which corresponds to evaporator boxes 46, 48 and 50 in FIG. 1. These components are contained within an insulated wall and bottom structure 258 which has internal walls 260 and 262 connected by a bottom floor 264 in order to form a product display case 266. A refrigerated air band denoted by arrows A is maintained about walls 260, 262 and bottom member 264 within an refrigerated air conduit 268. Due to the low temperature of the circulated air band and the contact of that air band with ambient air moisture condensate can form on return inlet air grille 250. This grille can then be warmed by the flow of refrigerant gas and the returned gas line 270 taken to a return point in the heater system 76 as described in regard to FIG. 1. The sensible heat and/or heat of condensation in the gas flow line can be utilized to raise the temperature of the air grille structural members above the dew point of the refrigerated air/ambient air mixture coming in contact with the grille. Also shown in FIG. 8 is a rub rail 272 which can by heated by the auxiliary gas flow line as described in reference to FIG. 10 below. The other structural elements in FIG. 8 are further described in U.S. Pat. No. 3,371,503 to A. Perez.

Figure 9:
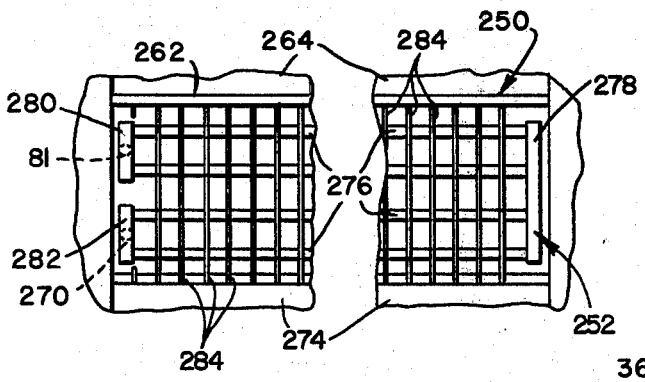
FIG. 9 shows a plan view of the air grille illustrated in FIG. 8.

FIG. 9 shows a view of the air grille 250 which is positioned between a hold down plate 274 and the internal wall 262. The auxiliary gas flow line for the air grille 250 is provided by a plurality of runs of tubing 276 which extend longitudinally of the inlet of air conduit 268. In the specific embodiment shown, for such lengths of tubing as are employed, all are connected at one end by a common manifold 278, with two of the lengths being connected at the opposite ends by a manifold 280 and the other two lengths being connected at the two opposite ends by a manifold 282. Manifold 280 is connected to the auxiliary flow line 81 and manifold 282 is connected to return gas flow line 270. The refrigerant gas thus flows first through the manifold 280 and the tubes 276 connected thereto and then into manifold 278 and through the two flow tubes connected to manifold 282 prior to being returned to the primary refrigeration circuit by line 270. The grille is completed by a plurality of bars 284 which connect transversely in order to support the gas flow tubing 276. The grille may be supported in any suitable manner, as shown, wherein the ends of the bars are connected to the cover plate 274 and to internal wall 262. Due to the low temperature of refrigerant gas flowing in auxiliary gas flow line 81, the temperature in the grille tubing is below the temperature where buckling and warping of the tubing 276 would occur in an unacceptable manner.

Figure 10:
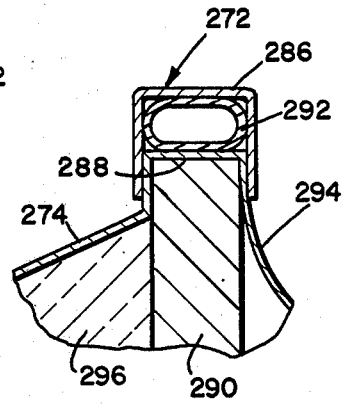
FIG. 10 shows an enlarged cross-sectional view of the auxiliary gas flow line positioned in contact with the rub-rail of the open top display cabinet shown in FIG. 8.

FIG. 10 shows an enlarged view of rub rail 272 in FIG. 8. This rail consists of an inverted U-shaped bracket 286 which is fitted to a base plate 288 which is in turn supported on the top of front wall 290. An elliptical shaped refrigerant gas flow line 292 is positioned under inverted U-shaped bracket 286 and is in contiguous contact therewith in order to heat the same above the dew point of the surrounding ambient air. Hold down plate 274 and the front rub-rail skirt 294 are also shown in this view. A insulation material 296 is also shown underlying hold down plate 274. Gas flow line 292 can be connected into the manifolds 280 and 282 of FIG. 9 to provide a continual flow of refrigerant gas through the tubing 276 and 292.

Figure 11:
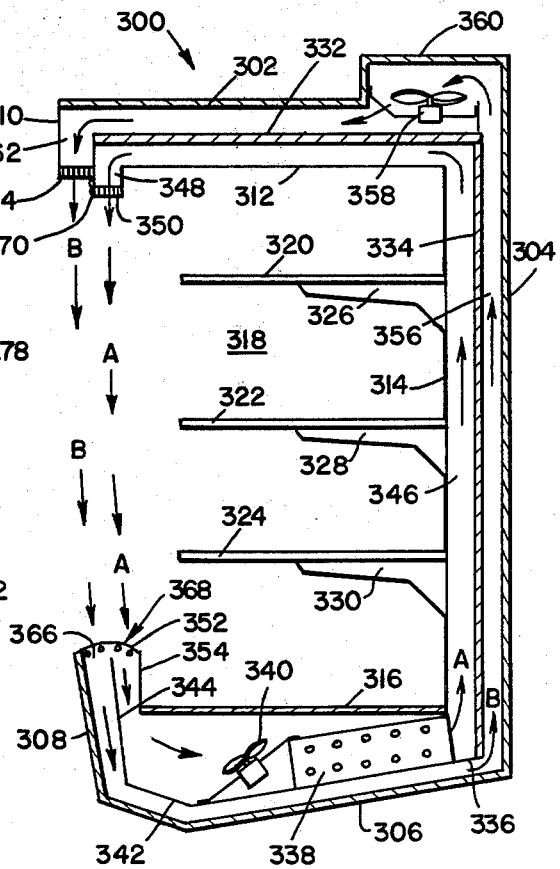
FIG. 11 shows a schematic cross-sectional view of an open front refrigerated display cabinet having auxiliary gas flow lines used for heating several structural parts thereof.

Referring now to FIG. 11, a schematic cross-sectional view of an open front refrigerated display cabinet 300 is shown having a top wall 302, a rear wall 304, a bottom wall 306, and a lower front wall 308. A top front wall 310 is connected to the front edge of top wall 302. An interior top panel 312, a back panel 314, and a bottom panel 316 form an interior display space 318 in which are positioned a plurality of product support shelves 320, 322, and 324 and support brackets 326–330. A top divider panel 332 is positioned between top wall 302 and interior top wall 312 and is connected at rear most edge thereof to a vertical divider panel 334 which is in turn connected at the bottom edge thereof to a bottom separator panel 336 which provides support for evaporator coil box 338 and a primary air conduit fan and motor combination 340. Bottom separator panel 336 is also connected to an inclined bottom panel 342 and a vertical separator panel 344. The internal panel walls form a primary air conduit 346 with the separator panels 332, 334, 336, 342, and 344. A primary air band denoted by arrows A is circulated within this air conduit 346 which has a conduit outlet 348 covered by an downwardly directed louver grille 350. Air band A flows downwardly under the suction from motor-fan combination 340 and enters the conduit inlet 352 which is formed by vertical separator panel 344 and an internal bottom wall 354. Primary air band A is circulated in an counter-clockwise direction within primary air conduit 346 during a refrigeration cycle of operation. A secondary air band conduit 356 is provided surrounding the primary air conduit 346 to the outside of the divider and separator panels. A secondary air band B is circulated through secondary air conduit 356 by operation of motor fan combination 358 positioned in top fan housing 360. Secondary air conduit 356 has an outlet 362 at the top portion thereof in which downwardly directed louvers 364 are positioned. The secondary conduit inlet 366 is shown adjacent to the primary conduit inlet 352. Both of these conduit inlets are covered over by an air grille 368 which can be similar in appearance and construction to air grille 250 described with reference to FIGS. 8 and 9 above. The tubing in this air grille can be part of the auxiliary refrigerant gas flow line 81 described in reference to FIGS. 1–5 above. By positioning the lower temperature gas flow lines within the air grille structure, the air grille can have the temperature thereof raised above the dew point of the primary and secondary air band in order to maintain the inlet grille free from moisture condensate and at the same time avoid the problems of buckling and warpage in the gas lines and customer discomfort upon coming in contact with a gas flow line heated at the temperature of a compressor discharge gas of 150° F. to 220° F. Another part of the structure of display cabinet 300 which is subject to condensate and/or frost build-up is the conduit outlet structure adjacent to the outlets 348 and 362 in the top front portion of the cabinet. Consistent with this invention the auxiliary gas flow line 81 can be arranged in the form of longitudinally disposed tubing 370 located in contiguous contact with portions of the outlet structure as shown.

Controls for the operation of the primary refrigeration circuit described above in the various figures can be provided by conventional control and valve arrangements. Control circuitry can utilize various sensor and control loops which are known in this art. Also, operation of the various refrigerated display cabinets described above with respect to air flow and circulated air bands can be in accordance with disclosures elsewhere in this art.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a low temperature display cabinet containing refrigeration means associated with a portion of the structure thereof, said refrigeration means comprising an expansion valve and evaporation coils serially connected within a refrigeration circuit for cooling said cabinet, said circuit including a compressor for enabling refrigerant flow and a condenser; the improvement comprising:

a refrigerant gas heater system having at least one auxiliary gas flow line located in heat exchange contact with a cooled portion of said cabinet structure; said flow line connected by a first portion thereof to a refrigerant gas sourcing point downstream from said compressor and at an upstream position from said condenser; a desuperheating means connected to said first portion of said flow line for lowering the temperature of said gas; an inlet end of said gas flow line connected to said desuperheating means and containing desuperheated refrigerant gas at a temperature within the range of about 80° F. to 130° F., and a pressure at least equivalent to the equilibrium saturated vapor pressure at 50° F., said gas flow line providing heat for the contacted portion of said cabinet structure by transfer of sensible heat and the heat of condensation of said gas and, said auxiliary flow line connected by the outlet end thereof to said refrigeration circuit downstream from said gas sourcing point.

2. The improvement according to claim 1, wherein said desuperheated refrigerant gas in said inlet end of said flow line is maintained in a superheated condition.

3. The improvement according to claim 1, wherein said desuperheating means comprises a condenser flow line cooled by a fluid external to said refrigeration circuit.

4. The improvement according to claim 3, wherein said condenser cooling fluid is ambient air.

5. The improvement according to claim 1, wherein said desuperheating means comprises a liquid-gas refrigerant mixing means wherein refrigerant liquid from a point downstream from said condenser is mixed with refrigerant gas from said compressor in proportions sufficient to desuperheat said gas.

6. The improvement accroding to claim 5, wherein said desuperheating means is a venturi tube mixer.

7. The improvement according to claim 5, wherein said desuperheating means is a mixing tube having a pressure reduction orifice therein for reducing the refrigerant gas pressure.

8. The improvement according to claim 1, wherein a proportioning valve is positioned in said refrigeration circuit downstream from said compressor for shunting off 15% to 25% of the compressor mass discharge into said refrigerant gas sourcing point.

9. The improvement according to claim 8, wherein said proportioning valve functions under fixed proportion conditions.

10. The improvement according to claim 8, wherein said proportioning valve functions under variable proportion conditions.

11. The improvement according to claim 1, wherein said outlet end of said gas flow line is connected to said refrigeration circuit at the upstream side of said condenser.

12. The improvement according to claim 1, wherein said outlet end of said gas flow line is connected to said refrigeration circuit at an intermediate point of said condenser.

13. The improvement according to claim 1, wherein said outlet end of said gas flow line is connected to said refrigeration circuit at the downstream side of said condenser.

14. The improvement according to claim 1, wherein a secondary condenser means is attached to said outlet end of said auxiliary flow line for assuring condensation to the liquid phase prior to return of said refrigerant into said refrigeration circuit.

15. The improvement according to claim 1, wherein a refrigerant gas flow control means is provided for regulating the flow of refrigerant gas within said auxiliary refrigerant gas flow line as a function of the heat input requirements for the contacted portion of said cabinet structure in order to substantially prevent moisture condensate formation on said cooled portion thereof.

16. The improvement according to claim 1, wherein the refrigerant temperature in said auxiliary flow line at the outlet end thereof is in the range of 70° F. to 90° F., and wherein said refrigerant is at an enthalpy condition at least equal to that of saturated liquid at 130° F.

17. The improvement according to claim 1, wherein a liquid receiver is provided within said refrigeration circuit downstream from said condenser and upstream from said expansion valve and wherein said outlet end of said auxiliary flow line is connected to said receiver.

18. The improvement according to claim 1, wherein the enthalpy loss within said auxiliary refrigerant gas flow line is within the range of about 35 to 55 BTU/-pound of refrigerant.

19. A display cabinet refrigeration and heater system comprising:

refrigeration means associated with a portion of the structure of said cabinet and including an expansion valve and evaporation coils; said refrigeration means serially connected within a refrigeration circuit; said circuit containing a compressor for enabling refrigerant flow and energy input and a condenser located at a remote position from said cabinet; a refrigerant gas heater system having an auxiliary refrigerant gas flow line located in heat exchange contact with a cooled portion of said cabinet structure; said auxiliary gas flow line connected by a first portion thereof to said refrigeration circuit at a refrigerant gas sourcing point downstream from said compressor and at an upstream position from said condenser; a desuperheating means connected to said first portion of said flow line for lowering the temperature of said gas; an inlet end of said gas flow line containing desuperheated refrigerant gas at a temperature within the range of about 80° F. to 130° F. and a pressure at least equivalent to the equilibrium saturated vapor pressure at 50° F., said gas flow line providing heat for the contacted portion of said cabinet structure by transfer of sensible heat and the latent heat of condensation thereof, and said auxiliary gas flow line connected by the outlet end thereof to said refrigerant circuit at a position downstream from said gas sourcing point.

20. The display cabinet according to claims 1 or 19, wherein barrier doors and associated door mullions and jambs are provided for said cabinet and wherein said auxiliary refrigerant gas flow line is in contiguous contact with at least one of said mullions and said jambs for heating the same above the ambient condition dew point to prevent moisture condensation thereon.

21. The display cabinet according to claims 1 or 19, wherein said cabinet includes at least one circulated low temperature air band conduit having inlet and outlet flow ports spaced by an access opening, and wherein said auxiliary refrigerant gas flow line is positioned in contiguous contact with the structural portions of said cabinet forming said conduit for heating said portions to prevent moisture condensate accumulation thereon.

22. The display cabinet according to claims 1 or 19, wherein said cabinet includes at least one rub rail positioned for contact by users, and wherein said auxiliary refrigerant gas flow line is positioned in contiguous heat transfer contact with said rail to prevent moisture condensate accumulation thereon.

23. The display cabinet according to claims 1 or 19, wherein refrigerant gas enters and exits from said auxiliary flow line at temperature, pressure and enthalpy conditions within an operational area defined by the pressure-enthalpy diagram of FIG. 6.

24. The display cabinet according to claims 1 or 19, wherein refrigerant gas line inlet and outlet conditions are within an operational area defined by the temperature limits of about 80° F. to 130° F. extending from a constant enthalpy line passing through the higher temperature limit into the superheated gas region of the pressure-enthalpy diagram for the refrigerant and wherein 15% to 20% of said operational area is within the superheated region.

25. The display cabinet according to claim 19, wherein a refrigerant gas flow line control means is provided for regulating the flow of refrigerant within said auxiliary flow line in response to the heat input requirements for the contacted portion of said cabinet structure to substantially prevent moisture condensate formation on said cooled portion thereof.

26. The display cabinet according to claim 19, wherein the refrigerant temperature in said auxiliary flow loop at the outlet end thereof is in the range of 70° F. to 90° F., and wherein said refrigerant is at an enthalpy condition at least equal to that of saturated liquid at 130° F.

27. The display cabinet according to claim 19 wherein said desuperheating means is cooled by heat exchange with a fluid external to said refrigeration circuit.

28. The display cabinet according to claim 19 wherein said desuperheating means comprises a venturi tube liquid injector wherein condensed refrigerant liquid is injected into the refrigerant gas flowing through said venturi tube.

29. The display cabinet according to claim 19 wherein said desuperheating means comprises an orifice-constricted flow tube wherein condensed refrigerant liquid is injected into the refrigerant gas flowing through said flow tube.

30. The display cabinet according to claims 1 or 19, wherein said desuperheating means comprises a liquid refrigerant injection means located immediately downstream from said compressor for enabling contact of the refrigerant gas with a lower temperature refrigerant liquid.

31. The display cabinet according to claims 1 or 19, wherein said desuperheating means comprises a heat exchanger having hot compressor outlet gas on one side cooled by exchange with a secondary evaporation coil connected in parallel with said refrigeration means in display cabinet.

32. The display cabinet according to claims 1 or 19, wherein said desuperheating means comprises a length of flow line arranged in a heat sink.

33. In a low temperature display cabinet containing refrigeration means associated with a portion of the structure thereof, said refrigeration means comprising an expansion valve and evaporation coils serially connected within a refrigeration circuit for cooling said cabinet, said circuit including a compressor for enabling refrigerant flow and a condenser; the improvement comprising:

a refrigerant gas heater system having at least one auxiliary gas flow line located in heat exchange contact with a cooled portion of said cabinet structure; said flow line connected by a first portion thereof to a refrigerant gas sourcing point downstream from said compressor and at an upstream position from said condenser; a desuperheating means connected to said first portion of said flow line for lowering the temperature of said gas; an inlet end of said gas flow line connected to said desuperheating means and containing desuperheated refrigerant gas at a temperature less than about 130° F., said gas flow line providing heat for the contacted portion of said cabinet structure by transfer of sensible heat and the heat of condensation of said gas and, said auxiliary flow line connected by the outlet end thereof to said refrigeration circuit downstream from said gas sourcing point.

34. The improvement according to claim 33, wherein said desuperheated refrigerant gas in said inlet end of said flow line is maintained in a superheated condition.

35. The improvement according to claim 33, wherein said desuperheating means comprises a condenser flow line cooled by a fluid external to said refrigeration circuit.

36. The improvement according to claim 33, wherein said condenser cooling fluid is ambient air.

37. The improvement according to claim 33, wherein said desuperheating means comprises a liquid-gas refrigerant mixing means wherein refrigerant liquid from a point downstream from said condenser is mixed with refrigerant gas from said compressor in proportions sufficient to desuperheat said gas.

38. The improvement according to claim 33, wherein a proportioning valve is positioned in said refrigeration circuit downstream from said compressor for shunting off 15% to 25% of the compressor mass discharge into said refrigerant gas sourcing point.

39. The improvement according to claim 38, wherein said proportioning valve functions under fixed proportion conditions.

40. The improvement according to claim 38, wherein said proportioning valve functions under variable proportion conditions.

41. The improvement according to claim 33, wherein the refrigerant gas temperature in said auxiliary flow line at the inlet end thereof is within the range of about 80° F. to 130° F., and wherein said refrigerant gas is at a pressure at least equivalent to the equilibrium saturated vapor pressure at 50° F.

42. A method of preventing moisture condensate formation on structural parts of a low temperature display cabinet containing refrigeration means including an expansion valve and evaporation coils for cooling the cabinet, the refrigeration means serially connected within a refrigeration circuit which includes a compressor for enabling refrigerant flow and a condenser comprising the steps of:

withdrawing refrigerant gas from the refrigeration circuit at a refrigerant gas sourcing point downstream from the compressor and upstream from the condenser, desuperheating said refrigerant gas to a temperature within the range of about 90° F. to 130° F. and a pressure at least equivalent to the saturated vapor pressure at 50° F., passing the gas through an auxiliary refrigerant gas flow line located in heat exchange contact with the cooled structural parts of the cabinet, and returning the refrigerant gas to the refrigeration circuit at a point downstream from the refrigerant gas sourcing point.

43. A method according to claim 42, wherein a desuperheating means is provided within the refrigeration circuit downstream from the compressor for extracting heat energy from the refrigerant gas in said desuperheating step to maintain the same within the stated temperature and pressure limits.

44. A method according to claim 43, wherein the desuperheating means functions by mixing of refrigerant liquid from the refrigeration circuit with the refrigerant gas.

45. A method according to claim 43, wherein the desuperheating means functions by cooling the refrigerant gas when contained within a flow line with ambient air.

46. A method according to claim 43, wherein the desuperheating means functions by flowing of the refrigerant gas through a line arranged in a heat sink.

47. A method of preventing moisture condensate formation on structural parts of a low temperature display cabinet containing refrigeration means including an expansion valve and evaporation coils for cooling the cabinet, the refrigeration means serially connected within a refrigeration circuit which includes a compressor for enabling refrigerant flow and a condenser arranged along a refrigerant flow path; comprising:

withdrawing refrigerant gas from the refrigeration circuit at a refrigerant gas sourcing point downstream from the compresor and upstream from the condenser, desuperheating said refrigerant gas to a temperature within the range of about 90° F. to 130° F. and at a pressure of at least that of the saturated vapor at 50° F., passing the refrigerant gas within an auxiliary refrigerant gas flow line located in heat exchange contact with a cooled structural part of the cabinet in order to warm the same to prevent moisture condensate formation thereon, the refrigerant gas flow line warming the cooled structural part by flow of sensible heat and by release of the heat of condensation of the gas, and thereafter returning the refrigerant fluid to an entry point in the refrigeration circuit downstream from the refrigerant gas sourcing point.

48. A method according to claim 47, wherein the return refrigerant gas is at least partly mixed with condensed refrigerant liquid upon reentry into the refrigeration circuit.

49. A method according to claim 47, wherein a desuperheating means is provided within the refrigeration circuit downstream from the compressor for extracting heat energy from a flow line containing the refrigerant gas to maintain the same within the stated temperature and pressure limits, said extracting of heat energy provided for by a heat sink.

50. A method according to claim 49, wherein the heat sink is the ambient air.

* * * * *